US010707587B2

(12) United States Patent
Hibino

(10) Patent No.: US 10,707,587 B2
(45) Date of Patent: Jul. 7, 2020

(54) CONNECTOR AND TERMINAL FITTING

(71) Applicant: Sumitomo Wiring Systems, Ltd., Yokkaichi, Mie (JP)

(72) Inventor: Takuma Hibino, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/294,130

(22) Filed: Mar. 6, 2019

(65) Prior Publication Data

US 2019/0305444 A1 Oct. 3, 2019

(30) Foreign Application Priority Data

Mar. 29, 2018 (JP) ..... 2018-064121

(51) Int. Cl.
*H01R 4/20* (2006.01)

(52) U.S. Cl.
CPC ..... *H01R 4/20* (2013.01)

(58) Field of Classification Search
CPC ..... H01R 4/20; H01R 13/432; H01R 13/115; H01R 13/502
USPC ..... 439/877
See application file for complete search history.

(56) References Cited

U.S. PATENT DOCUMENTS 3,414,871 A * 12/1968 Tuchel ..... H01R 13/428 439/748
4,620,766 A * 11/1986 Leonard ..... H01R 13/432 439/748
4,726,792 A * 2/1988 Shindo ..... H01R 13/428 439/748
5,575,692 A * 11/1996 Cecil, Jr. ..... H01R 13/4368 439/752
5,622,521 A * 4/1997 Marceau ..... H01R 13/4368 439/595
5,645,453 A * 7/1997 Yamaguchi ..... H01R 13/4365 439/595
6,109,982 A * 8/2000 Okabe ..... H01R 43/20 439/595
6,280,261 B1 * 8/2001 Sakurai ..... H01R 13/432 439/746
6,533,611 B2 * 3/2003 Morello ..... H01R 13/4361 439/595
7,988,489 B2 * 8/2011 Schmitt ..... H01R 13/4223 439/595
8,376,778 B2 * 2/2013 Obata ..... H01R 13/4223 439/595
8,651,901 B2 * 2/2014 Beck, Jr. ..... H01R 13/4365 439/595
9,472,883 B2 * 10/2016 Honnige ..... H01R 13/42
(Continued)

FOREIGN PATENT DOCUMENTS

JP 2006-79922 3/2006

*Primary Examiner* — Alexander Gilman
(74) *Attorney, Agent, or Firm* — Gerald E. Hespos; Michael J. Porco; Matthew T. Hespos

(57) ABSTRACT

A connector includes a housing (60) having an accommodating portion (62) and a terminal fitting (10) to be inserted into the accommodating portion (62). The terminal fitting (10) includes resilient portions (25) configured to restrict a loose movement of the terminal fitting (10) in the accommodating portion (62) by coming into contact with an inner surface of the accommodating portion (62) while being resiliently deformed. The resilient portion (25) includes a front projection (28) and a rear projection (29) on an outer surface.

7 Claims, 10 Drawing Sheets

(56) References Cited

U.S. PATENT DOCUMENTS

| | | | | |
|---|---|---|---|---|
| 10,340,618 | B1 * | 7/2019 | Probert | H01R 13/4223 |
| 2002/0016106 | A1 * | 2/2002 | Okayasu | H01R 13/4365<br>439/595 |
| 2004/0067686 | A1 * | 4/2004 | Nimura | H01R 13/4365<br>439/595 |
| 2006/0052004 | A1 * | 3/2006 | Yamashita | H01R 13/4362<br>439/595 |
| 2006/0141862 | A1 * | 6/2006 | Machida | H01R 13/4223<br>439/595 |
| 2006/0160420 | A1 * | 7/2006 | Takahashi | H01R 13/4223<br>439/595 |
| 2007/0020997 | A1 * | 1/2007 | Miyakawa | H01R 13/4364<br>439/595 |
| 2007/0275599 | A1 * | 11/2007 | Sugiyama | H01R 13/4223<br>439/595 |
| 2009/0311896 | A1 * | 12/2009 | Myer | H01R 13/4365<br>439/248 |

* cited by examiner

CONNECTOR AND TERMINAL FITTING

BACKGROUND

Field of the Invention

The invention relates to a connector and a terminal fitting.

Related Art

Japanese Unexamined Patent Publication No. 2006-79922 discloses a connector that includes a housing having a cavity and a terminal fitting (shield terminal) to be inserted into the cavity. The terminal fitting includes a body and stabilizers protrude left and right from the body. Guide grooves are formed in the housing and communicate with both left and right sides of the cavity. The stabilizers enter the corresponding guide grooves when the terminal fitting is in a proper posture to guide an inserting operation of the terminal fitting into the cavity. On the other hand, the stabilizers contact facing wall surfaces of the cavity to restrict further insertion if the terminal fitting is in an improper posture. In this way, erroneous insertion of the terminal fitting into the cavity is prevented.

The stabilizers are not deformed resiliently deformed and clearances are formed between the stabilizers and inner surfaces of the guide grooves due to manufacturing tolerances and the like. Similarly, a clearance also is formed between the body and the inner surface of the cavity. Thus, for example, the terminal fitting may rattle in the cavity if a wire (shielded cable) connected to the terminal fitting and pulled out from the housing vibrates. A terminal fitting that rattles in the cavity interferes with a front wall of a mating terminal fitting without facing right opposite to the mating terminal fitting when the connector is connected to a mating connector, Therefore, a connecting operation cannot be performed any further.

Japanese Unexamined Patent Publication No. 2006-79922 also discloses backlash eliminating ridges on the inner surface of the cavity and each backlash eliminating ridge contacts the body part of the terminal fitting to suppress rattling of the terminal fitting in the cavity. However, each backlash eliminating ridge is made of synthetic resin and may be squeezed by the terminal fitting. Thus, it is difficult to realize reliable backlash elimination.

Japanese Unexamined Patent Publication No. 2006-79922 also discloses a retainer to be inserted into the housing and held at a full locking position. Two locking ridges are provided on the retainer sandwich the stabilizers from both sides and can prevent the rattling of the terminal fitting in the cavity can be also suppressed by this. However, the locking ridges are made of synthetic resin and may be squeezed similar to the respective backlash eliminating ridges. Further, since the retainer separate from the housing is necessary, there is also a problem that application is limited.

The invention was completed on the basis of the above situation and aims to prevent the rattling of a terminal fitting.

SUMMARY

A connector of the invention includes a housing with an accommodating portion, and a terminal fitting to be inserted into the accommodating portion. The terminal fitting includes a resilient portion configured to restrict a loose movement of the terminal fitting in the accommodating portion by contacting an inner surface of the accommodating portion while being resiliently deformed.

A terminal fitting of the invention is to be inserted into an accommodating portion of a housing. The terminal includes a resilient portion configured to contact an inner surface of the accommodating portion while being resiliently deformed, and is accommodated in the accommodating portion with a loose movement restricted. Accordingly, a clearance between the terminal fitting and the inner surface of the accommodating portion is filled by the resilient portion and the terminal fitting cannot rattle in the accommodating portion. Particularly, since the resilient portion is provided on the terminal fitting, the resilient portion is not squeezed due to contact with the housing made of synthetic resin.

Further, the terminal fitting and the housing partially overlap, but an overlapping margin can be adjusted easily by a resilient deformation amount of the resilient portion.

A groove may extend in an inserting direction of the terminal fitting in the inner surface of the accommodating portion of the housing and an interfering portion may be provided on a surface of the groove. The resilient portion projects on a body of the terminal fitting and is inserted into the groove. A projection is on an outer surface and is configured to interfere with and to contact the interfering portion when insertion is completed. According to this configuration, sliding resistance between the housing and the resilient portion can be made smaller or zero in the process of inserting the terminal fitting. Thus, insertion efficiency is improved, and the projection reliably deforms the resilient portion.

The resilient portion projects on a body of the terminal fitting and a projection may be on an outer surface of the resilient portion. The projection is configured to contact the inner surface of the accommodating portion. According to this configuration, the projection reliably deforms the resilient portion.

Projections may be provided on front and rear sides of the outer surface of the resilient portion while being spaced apart in an inserting direction of the terminal fitting. According to this configuration, the clearance between the terminal fitting and the inner surface of the accommodating portion is filled up on the front and rear sides in the inserting direction of the terminal fitting. Thus, the rattling of the terminal fitting in the accommodating portion will not rattle while being inclined in a direction intersecting the inserting direction can be prevented with good reliability.

The projection may be embossed to bulge on the outer surface of the resilient portion. According to this configuration, the projection can be formed easily on the resilient portion.

DETAILED DESCRIPTION

An embodiment is described with reference to FIGS. 1 to 10. A connector of this embodiment is illustrated as a female shield connector and includes a housing 60 and a terminal fitting 10. The housing 60 is connected to an unillustrated mating housing. Note that, in the following description, a surface side of the housing 60 facing the mating housing at the start of connection is referred to as a front side concerning a front-rear direction and a vertical direction is based on figures except FIGS. 6 to 9.

Figure 4:
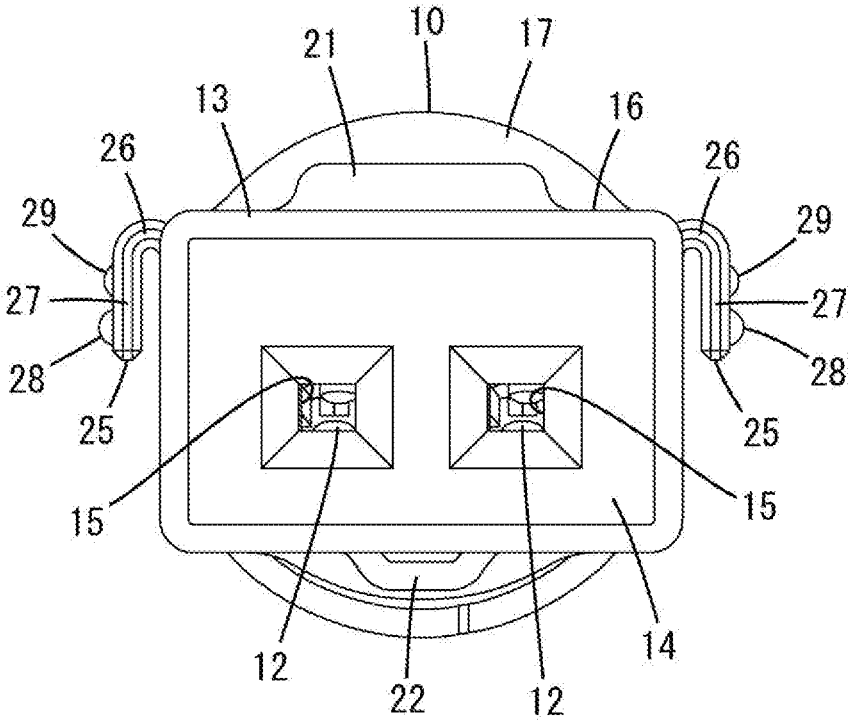
FIG. 4 is a front view of a terminal fitting.
Figure 5:
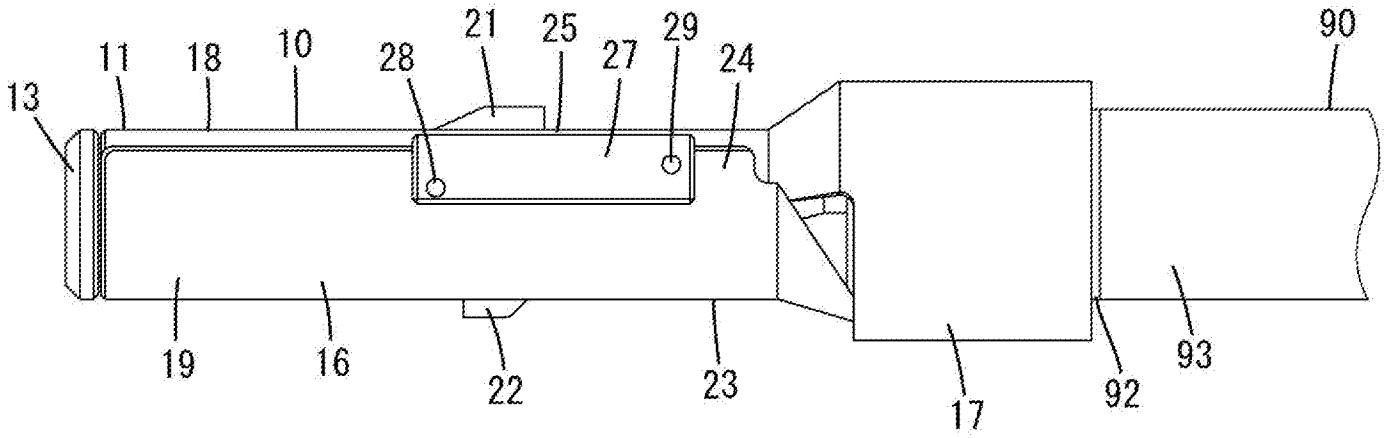
FIG. 5 is a side view of the terminal fitting.

As shown in FIG. 5, the terminal fitting 10 includes an outer conductor 11 made of conductive metal. Inner conductors 12 made of conductive metal are provided inside the outer conductor 11 and are to be crimped and connected to core parts on an end of a shielded cable 90 as partly shown in FIG. 4. A dielectric 13 made of synthetic resin is between the inner conductors 12 and the outer conductor 11. Two inner conductors 12 are provided in correspondence with two untwisted core parts (twisted pair cable) and are accommodated in parallel in the dielectric 13. The dielectric 13 includes left and right tab insertion openings 15 in a front wall 14 exposed on a front end. Tabs of unillustrated mating terminal fittings mounted in the mating housing are to be inserted into the tab insertion openings 15 of the dielectric 13. The tabs are connected electrically to connecting parts of the inner conductor 12 through the tab insertion openings 15.

As shown in FIG. 5, the outer conductor 11 includes a body 16 in the form of a rectangular box enclosing the inner conductors 12 and the dielectric 13 on a front side and a barrel 17 to be crimped and connected to a braided wire 92 on the end of the shielded cable 90. This braided wire 92 is folded back on the end part to cover an outer peripheral side of a sheath 93.

Further, as shown in FIG. 5, the outer conductor 11 is composed of an upper member 18 and a lower member 19. The upper and lower members 18 and 19 are assembled vertically to constitute the body 16 and the barrel 17. The upper member 18 includes a locking projection 21 cut and raised up on an upper wall, and the lower member 19 includes a retaining projection 22 cut and raised down on a lower wall.

The lower member 19 includes a bottom wall 23 in the form of a rectangular plate and left and right side walls 24 rising from both left and right sides of the bottom wall 23. The side walls 24 cover left and right sides of the upper member 18 from outside.

As shown in FIG. 4, the lower member 19 includes left and right resilient portions 25 that extend from the upper ends of the side walls 24 and then are folded back down. Each of the resilient portions 25 is a plate that is longer in the front-rear direction than in a vertical dimension, as shown in FIG. 5. Front ends of the resilient portions 25 overlap the locking projection 21 and the retaining projections 22 in the front-rear direction.

As shown in FIG. 4, each of the resilient portions 25 is composed of a base 26 and a plate 27. The base 26 is curved from the upper end of the side wall 24 to have a semicircular shape in a front view. The plate 27 hangs down from the base 26 to face an outer surface of the side wall 24 at a distance. The base 26 and the plate 27 have the same dimension in the front-rear direction and are continuous with one another along that dimension. The lower projecting end of the plate 27 is slightly above a vertical center of the body 16 so that the resilient portion 25 is on an upper part of the body 16. The plate 27 can resiliently deform in a lateral direction toward the outer surface of the side wall 24 with the base 26 as a support (see FIG. 10).

Each plate 27 has inner and outer surfaces that are mostly flat in the front-rear direction and the vertical direction. However, front and rear projection 28 and 29 at positions near the front and rear ends of the plates 27. As shown in FIG. 4, the front and rear projections 28, 29 are semispherical (dome-shaped) and are embossed to bulge on the outer surface of the respective plate 27. The projections 28, 29 are formed by striking the plate 27 from an inner side.

Figure 10:
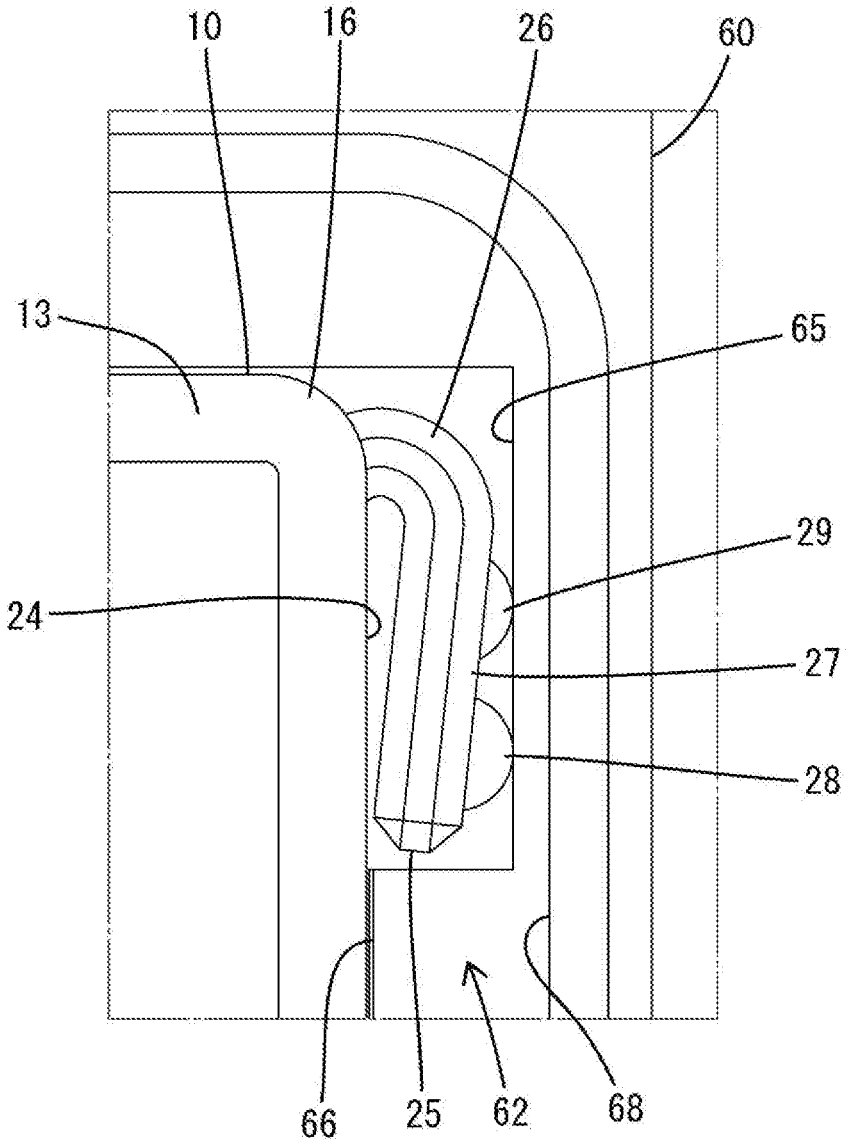
FIG. 10 is an enlarged front view showing a state where a resilient portion is in contact with an inner surface of the accommodating portion to be resiliently deformed.

As shown in FIG. 5, the front projection 28 is in front of the rear projection 29 and is on a lower front part of the plate 27. The rear projection 29 is located behind the front projection 28 and is near a vertical center of a rear part of the plate 27. As shown in FIG. 10, the front projection 28 has a larger projecting dimension from the outer surface of the plate 27 than the rear projection 29. The front and rear projections 28, 29 are shifted from each other in the vertical direction and can be visually confirmed in front and back views.

Figure 2:
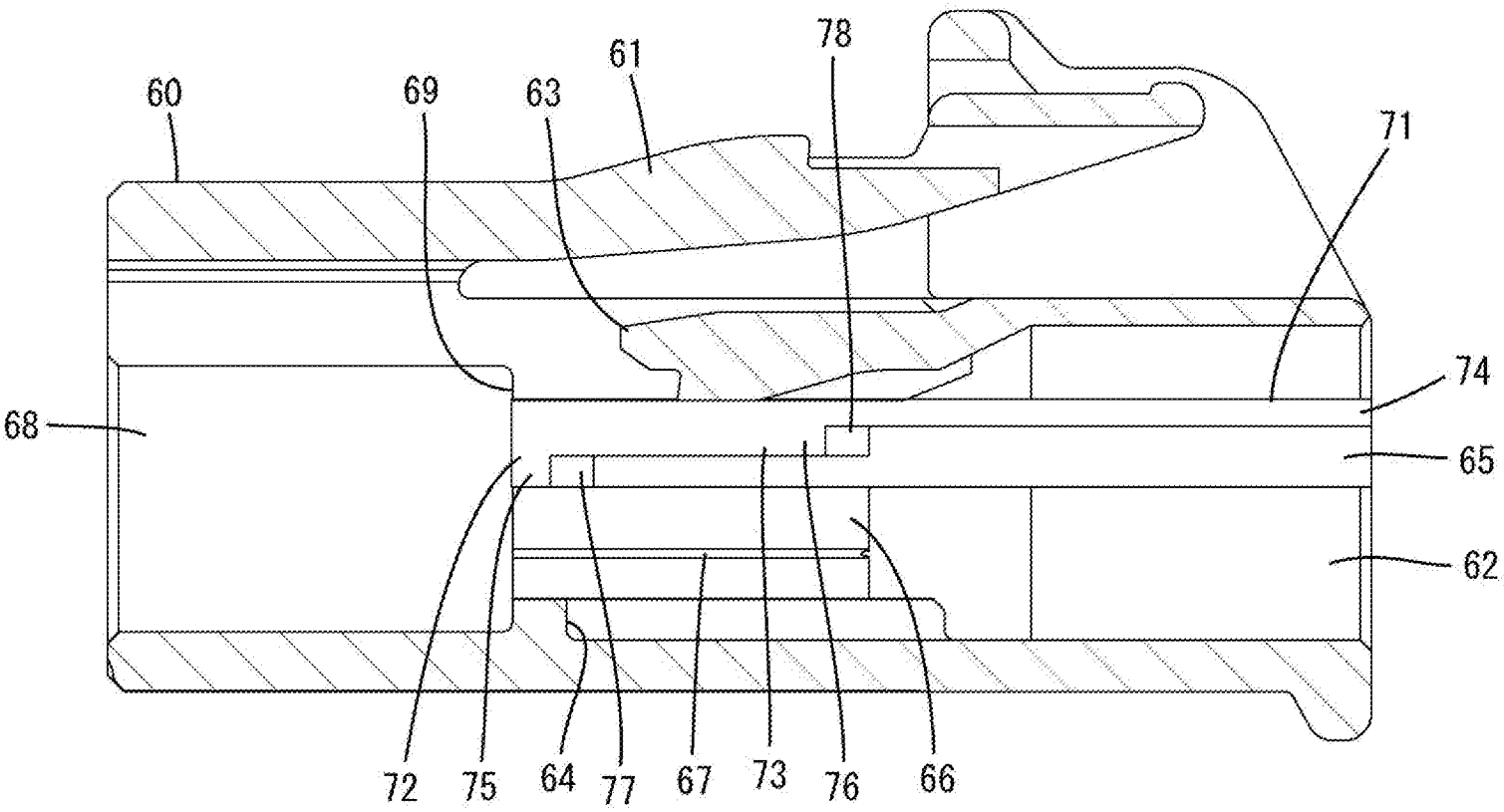
FIG. 2 is a section along A-A of FIG. 1.

The housing 60 is made of synthetic resin and includes, as shown in FIG. 2, a deflectable and deformable lock arm 61 cantilevered rearward on an upper part. The lock arm 61 holds the housings in a connected state by locking a lock of the mating housing.

An accommodating portion 62 penetrates the housing 60 in the front-rear direction, and a locking lance 63 is cantilevered forward on an upper wall of the inner surface of the accommodating portion 62. The locking lance 63 is deflectable and deformable in the vertical direction. The housing 60 includes a front stop 64 projecting into the accommodating portion 62 at a position slightly in front of the locking lance 63 on a lower wall of the inner surface of the accommodating portion 62. The terminal fitting 10 is inserted into the accommodating portion 62 of the housing 60 from behind. The rearward escape of the terminal fitting 10 is restricted by the locking projection 21 being resiliently locked by the locking lance 63 and any further forward movement of the terminal fitting 10 is restricted by the retaining projection 22 contacting the front stop 64. In this way, the terminal fitting 10 is held with front-rear movements with respect to the accommodating portion 62 restricted. The shielded cable 90 connected to the terminal fitting 10 extends rearward from the housing 60 when the entire terminal fitting 10 is accommodated properly into the accommodating portion 62 (see FIGS. 6 and 8).

Figure 1:
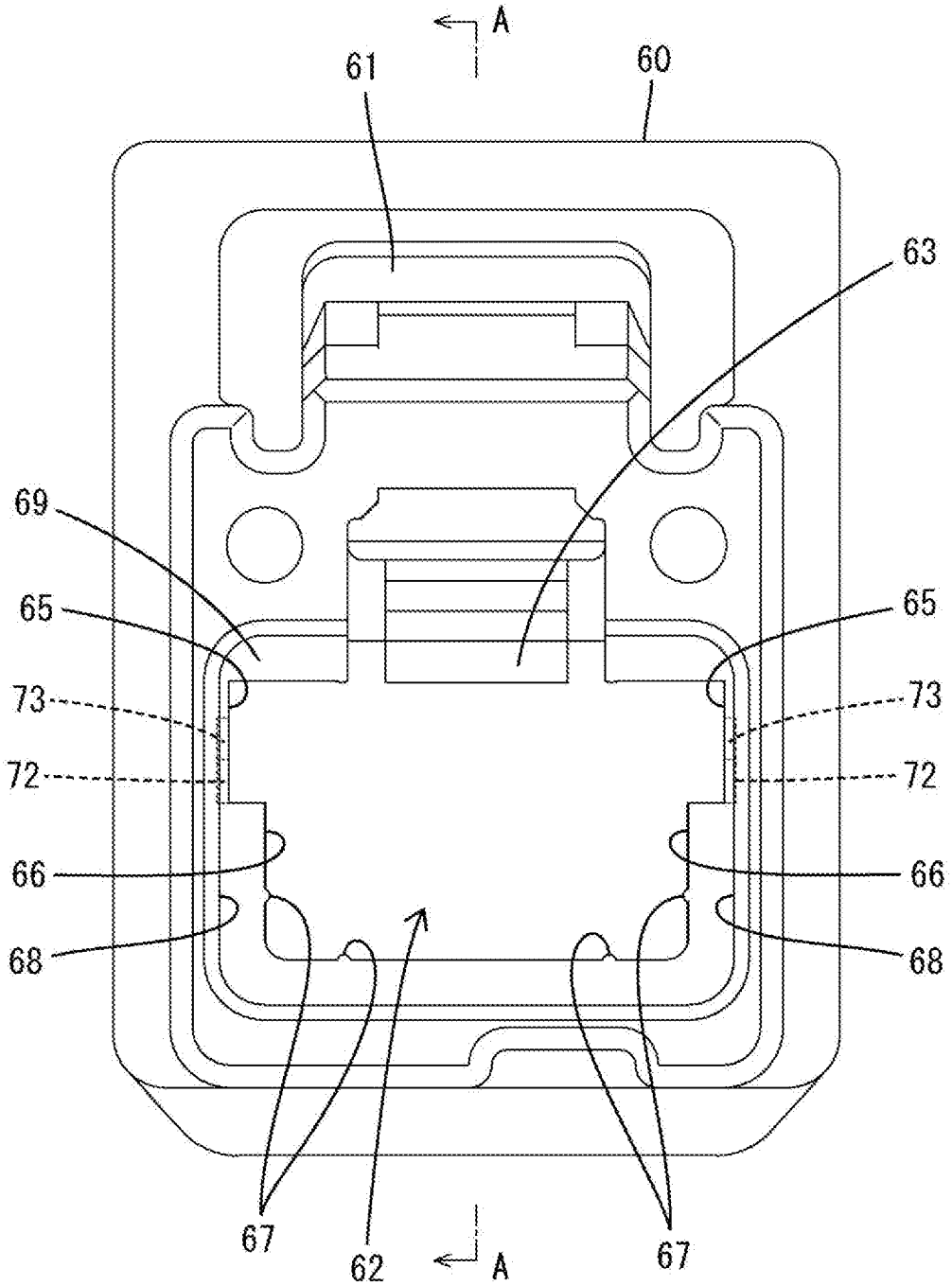
FIG. 1 is a front view of a housing in a connector of an embodiment of the invention.
Figure 3:
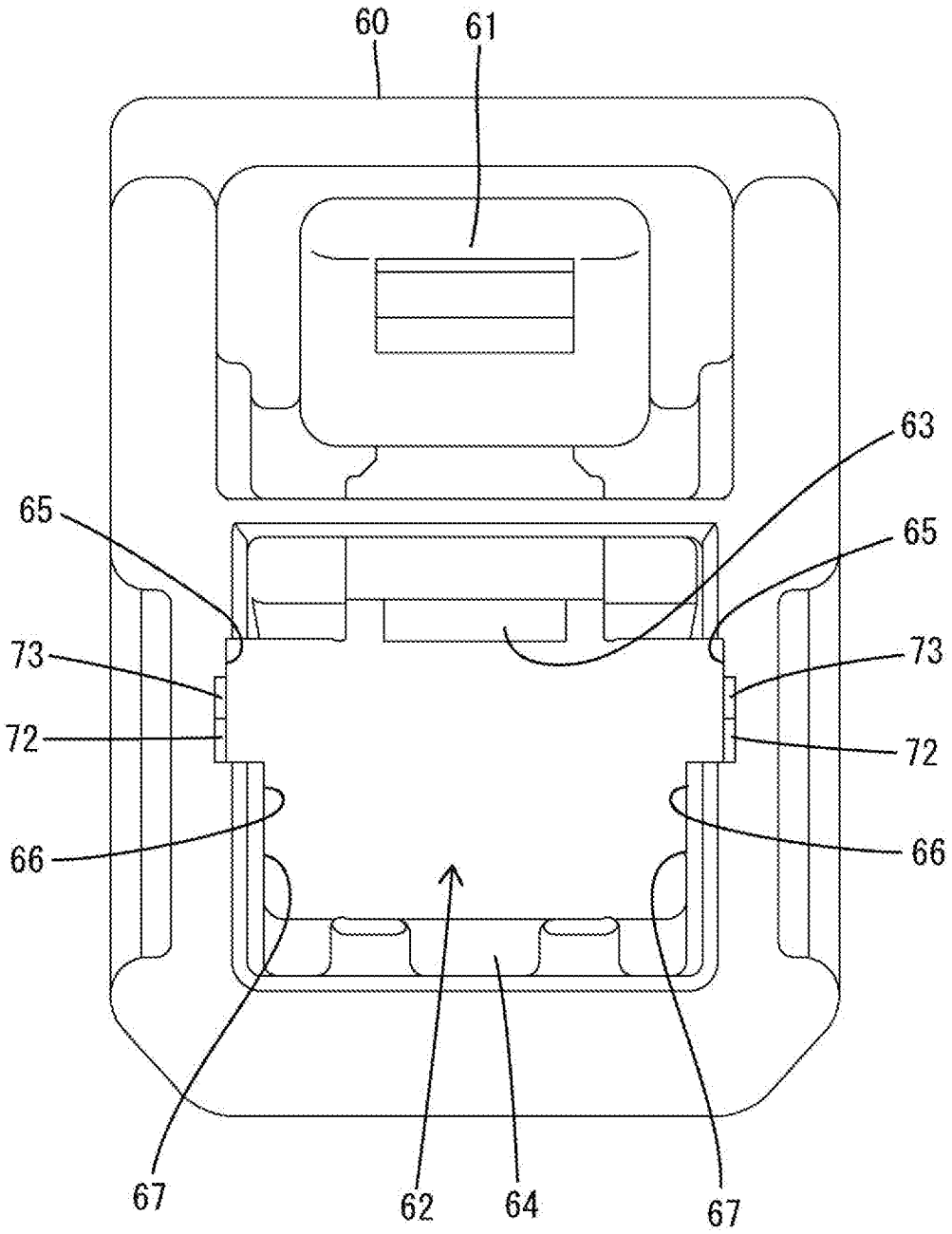
FIG. 3 is a back view of the housing.

Left and right grooves 65 are formed in upper parts of the inner surfaces of both side walls of the accommodating portion 62, as shown in FIGS. 1 and 3. Each groove 65 has a rectangular cross-section, extends in the front-rear direction and is open in the rear end of the housing 60. A vertical width of each groove 65 is slightly larger than a vertical dimension from the upper end of the base 26 to the lower end of the plate 27 of the resilient portion 25. The corresponding resilient portions 25 are inserted respectively into the grooves 65 when the terminal fitting 10 is inserted into the accommodating portion 62 (see FIGS. 6 to 9).

As shown in FIG. 1, left and right narrowing facing surfaces 66 are formed on inner surfaces of both side walls of the accommodating portion 62 at central positions in the front rear direction and are can contact both side surfaces of the body 16 of the terminal fitting 10. A space between the narrowing facing surfaces 66 of the housing 60 is narrower than in the other area between the side walls. As shown in FIG. 2, the lower surface of the groove 65 in the housing 60 intersects and connects to the narrowing facing surface 66 on a front side. As shown in FIG. 1, backlash eliminating ribs 67 extending in the front-rear direction on the both narrowing facing surfaces 66 of the housing 60. The backlash eliminating ribs 67 restrict a lateral positional deviation of the terminal fitting 10 by contacting the side surfaces of the body 16 of the terminal fitting 10. Note that backlash eliminating ribs 67 also are provided on a bottom wall part of the inner surface of the accommodating portion 62.

As shown in FIG. 1, left and right widening facing surfaces 68 are formed on both side walls of the inner surface of the accommodating portion 62 adjacent a front part of the housing 60 and are capable of contact both side surfaces of the body part of the unillustrated mating terminal fitting. A space between the widening facing surfaces 68 of the housing 60 is wider than in the other area between the side walls. A back surface 69 faces forward between the widening facing surfaces 68 and the narrowing facing surfaces 66 of the housing 60. As shown in FIG. 2, the front ends of the grooves 65 are open in the back surface 69.

The housing 60 includes left and right groove back portions 71 (only one is shown in FIG. 2) at upper parts of the grooves 65. Left and right first interfering portions 72 and left and right second interfering portions 73 are formed in front parts of the grooves 65 below the groove back portions 71. The groove back portion 71 and the first and second interfering portions 72 and 73 fill up the entire width of the groove 65 in the vertical direction.

As shown in FIG. 2, the groove back portion 71 extends over the entire length in the front-rear direction and includes a groove flat surface 74 flat along the front-rear direction and the vertical direction at a position facing the accommodating portion 62. The groove flat surface 74 intersects and connects to the upper surface of the groove 65.

The first and second interfering portions 72, 73 are arranged side by side in the vertical direction and shifted in the front-rear direction. The first interfering portion 72 is disposed in a lower part (lower half) of a front end part of the groove portion 65. The second interfering portion 73 includes a part located on a vertically central side of the front part of the groove portion 65 and extending further rearward than the first interfering portion 72. The front ends of the first and second interfering portions 72, 73 are intersecting and connected to the back surface 69.

Figure 6:
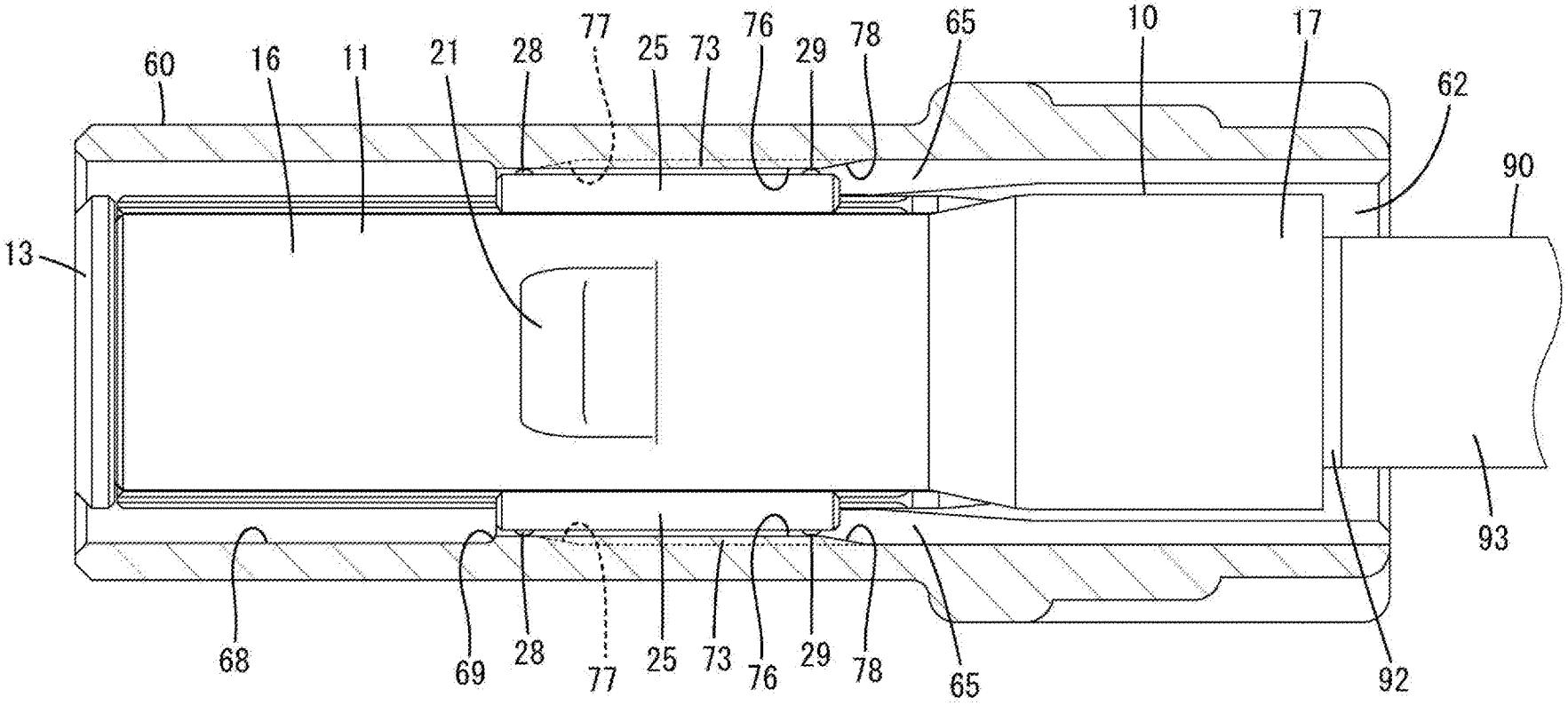
FIG. 6 is a section showing a state where the terminal fitting is inserted in an accommodating portion of the housing at lower heights of groove portions.
Figure 7:
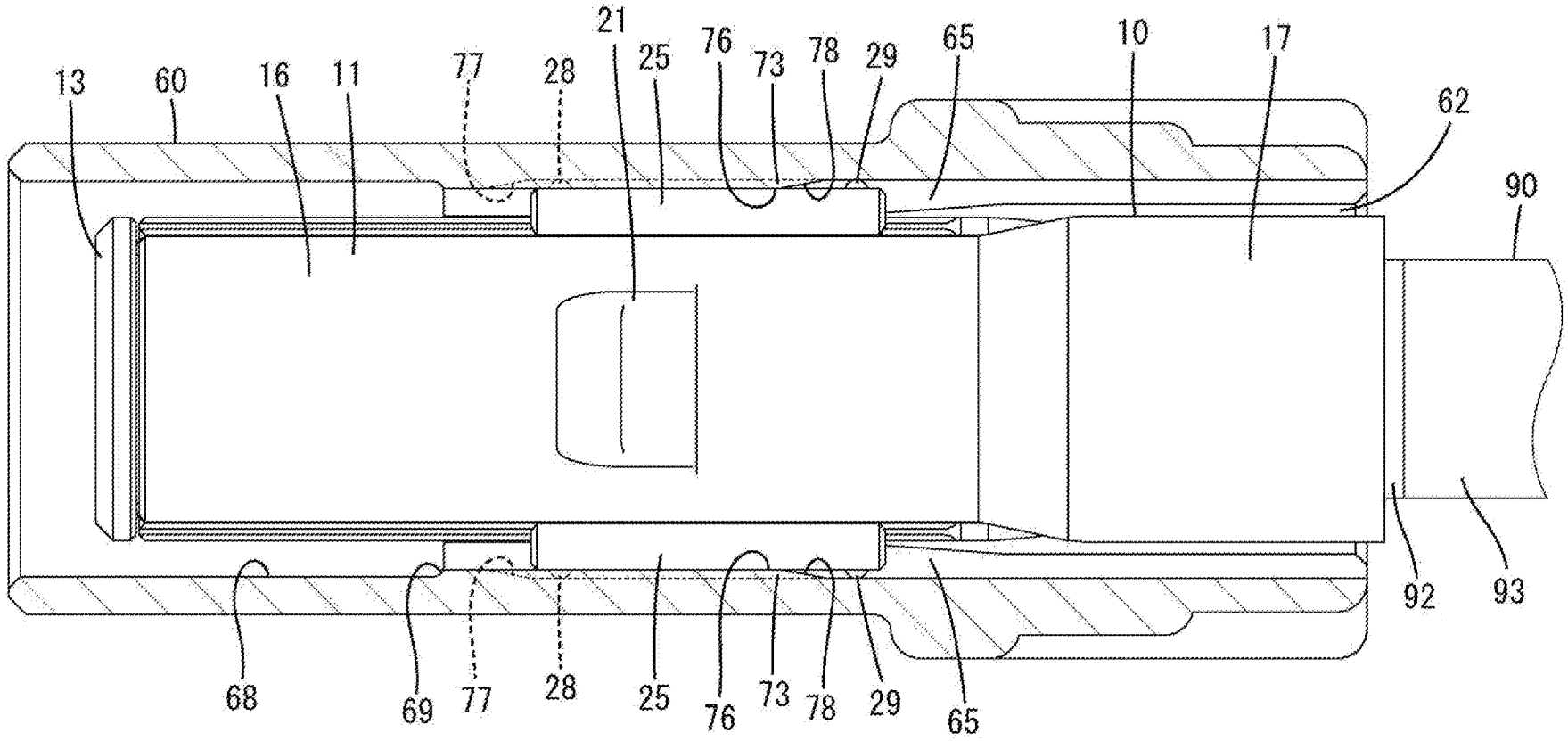
FIG. 7 is a section showing a state while the terminal fitting is being inserted into the accommodating portion of the housing at the lower heights of the groove portions.
Figure 8:
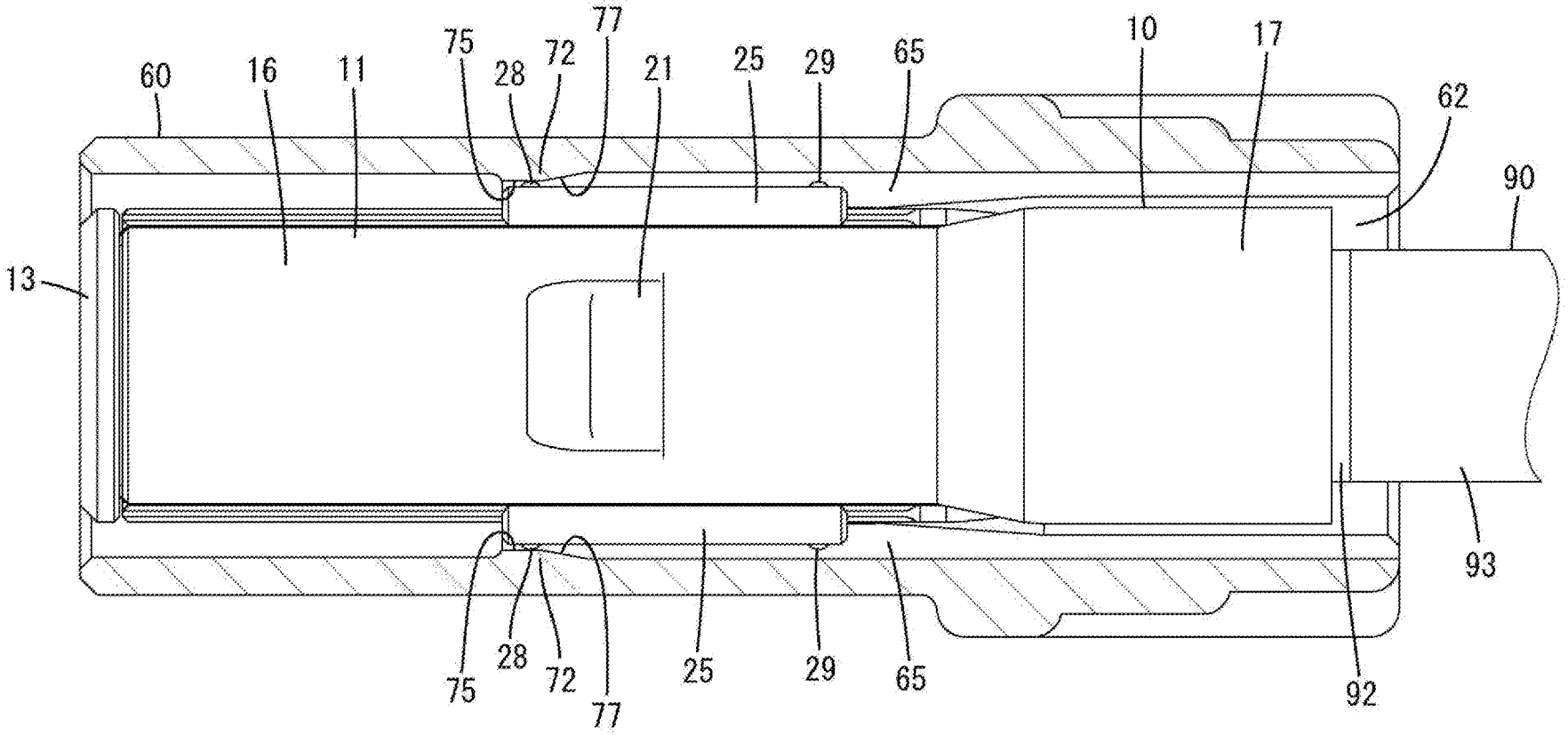
FIG. 8 is a section showing a state where the terminal fitting is inserted in the accommodating portion of the housing at upper heights of the groove portions.
Figure 9:
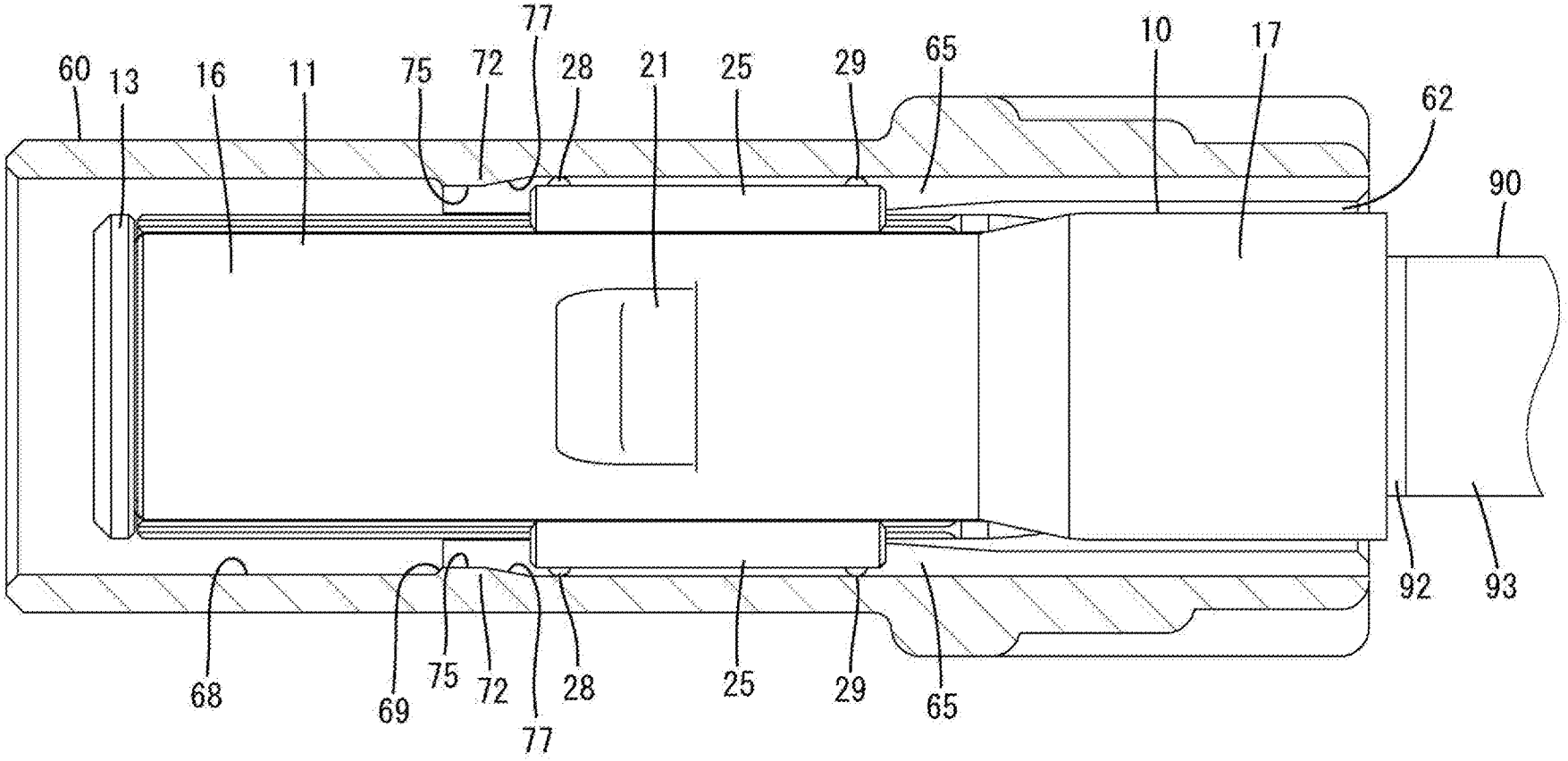
FIG. 9 is a section showing a state while the terminal fitting is being inserted into the accommodating portion of the housing at the upper heights of the groove portions.

As shown in FIGS. 2, 8 and 9, the first interfering portion 72 has a first interfering surface 75 flat along the front-rear direction and the vertical direction at a position facing the accommodating portion 62. Similarly, the second interfering portion 73 has a second interfering surface 76 flat along the front-rear direction and the vertical direction at a position facing the accommodating portion 62, as shown in FIGS. 2, 6 and 7. The lower end of the first interfering surface 75 is intersecting and connected to the lower surface of the groove 65. As shown in FIG. 2, the first interfering surface 75, the second interfering surface 76 and the groove flat surface 74 are continuous and flush with each other without any step.

As shown in FIGS. 2, 8 and 9, the first interfering portion 72 has a first guiding surface 77 inclined in a direction to fill up the groove 65 from the backmost side surface of the groove 65 to the first interfering surface 75. Similarly, the second interfering portion 73 has a second guiding surface 78 inclined in a direction to fill up the groove 65 from the backmost side surface of the groove 65 to the second interfering surface 76, as shown in FIGS. 2, 6 and 7. As shown in FIG. 2, the first guiding surface 77 is connected to the first interfering surface 75 while having the same width in the vertical direction. Further, the second guiding surface 78 is connected to the second interfering surface 76 while having the same width in the vertical direction. Rear ends of the second guiding surfaces 78 and the narrowing facing surface 66 are at substantially the same position in the front-rear direction.

Next, functions and effects of this embodiment are described.

In assembling, the terminal fitting 10 is inserted into the accommodating portion 62 of the housing 60 from behind. The terminal fitting 10 is crimped and connected to the end of the shielded cable 90 in advance. As shown in FIGS. 7 and 9, in the process of inserting the terminal fitting 10 into the accommodating portion 62, the resilient portions 25 enter the grooves 65 and the front and rear projections 28, 29 enter the grooves 65 to escape while being located respectively behind the first and second interfering portions 72, 73. Thus, in the process of inserting the terminal fitting 10, the grooves 65 do not impose significant sliding interference on the front and rear projections 28, 29.

In a final stage of inserting the terminal fitting 10, the front and rear projections 28, 29 substantially simultaneously start sliding respectively on the first and second guiding surfaces 77 and 78 so that the resilient portions 25 gradually deform resiliently with the bases 26 as supports. When the terminal fitting 10 is inserted properly, the locking lance 63 locks the locking projection 21, and the front and rear projections 28, 29 substantially simultaneously ride on the first and second interfering surfaces 75, 76 respectively. At this time, as shown in FIG. 10, the resilient portions 25 reach their maximum deformation. Large reaction forces of the resilient portions 25 are applied respectively to the first and second interfering portions 72, 73 via the front and rear projections 28, 29.

The resilient portions 25 apply reaction forces to the body 16 from left and right sides when the terminal fitting 10 is inserted properly in the accommodating portion 62. Thus, the terminal fitting 10 is held with loose movements restricted, and the terminal fitting 10 will not rattle in the accommodating portion 62 even if the shielded cable 90 vibrates. As a result, the terminal fitting 10 faces the mating terminal fitting when the housings are connected, and a connecting operation of the terminal fittings can be performed smoothly.

As described above, a clearance between the body 16 of the terminal fitting 10 and the inner surface of the accommodating portion 62 is filled by the resilient portions 25. As a result, the terminal fitting 10 will not rattle in the accommodating portion 62. The resilient portions 25 are made of metal. Thus, unlike the backlash eliminating ribs 67, the resilient portion 67 are not squeezed and suppress rattling of the terminal fitting 10 with high reliability. The terminal fitting 10 and the housing 60 overlap in the lateral direction, but overlap margins can be adjusted easily by deformation amounts of the resilient portions 25.

Further, in the process of inserting the terminal fitting 10 into the accommodating portion 62, the front and rear projections 28, 29 enter the grooves 65 to escape. Thus, sliding resistance between the housing 60 and the resilient portions 25 is small or nonexistent, and insertion efficiency is improved. In addition, resilient deformation of the first and second projections 28, 29 is highly reliable.

The front and rear projections 28, 29 are on the outer surfaces of the plates 27 of the resilient portions 25 while being spaced apart in the front-rear direction. Thus, the clearance between the body 16 of the terminal fitting 10 and the inner surface of the accommodating portion 62 is filled up on front and rear ends. As a result, rattling of the terminal fitting 10 in the accommodating portion 62 while being inclined in the lateral direction is prevented with good reliability. Further, the front and rear projections 28, 29 are embossed to bulge on the outer surfaces of the plates 27 of the resilient portions 25 and can be manufactured easily.

Other embodiments are described briefly below.

The resilient portion may be shaped to have base end portions on both longitudinal ends and supported on both ends.

The resilient portion may be formed by bending and raising a part between slits formed in the body of the terminal fitting.

The connector is not limited to a shield connector and the terminal fitting may be a general terminal fitting to be fixed to an end part of a coated wire not including a shield layer such as a braided wire. In this case, the dielectric can be omitted and the terminal fitting can be manufactured from a single metal plate. Further, the housing may include plural accommodating portions and plural terminal fittings.

The resilient portion may include a projection in addition to the front and rear projections on the outer surface. Conversely, the resilient portion may include only one projection on the outer surface.

The resilient portion may be configured such that a flat outer surface contacts the inner surface of the accommodating portion without the first and second projections.

Three resilient portions may be provided on the body of the terminal fitting. Conversely, only one resilient portion may be provided on the body of the terminal fitting.

LIST OF REFERENCE SIGNS

10 . . . terminal fitting
16 . . . body
25 . . . resilient portion
28 . . . front projection
29 . . . rear projection
60 . . . housing
62 . . . accommodating portion
72 . . . first interfering portion
73 . . . second interfering portion
90 . . . shielded cable (wire)

What is claimed is:

1. A connector, comprising:

a housing including an accommodating portion having an inner surface, a groove formed in the inner surface of the accommodating portion and extending in an inserting direction, and an interfering portion being provided on a surface of the groove; and a terminal fitting to be inserted into the accommodating portion along the insertion direction, the terminal fitting including a body and a resilient portion projecting on the body, the resilient portion being inserted into the groove as the terminal fitting is inserted into the accommodating portion, at least one projection provided on an outer surface of the resilient portion, the at least one projection interfering with and contacting the interfering portion when insertion is completed so that the resilient portion restricts a loose movement of the terminal fitting in the accommodating portion by contacting an inner surface of the accommodating portion while being resiliently deformed.

2. A terminal fitting to be inserted into an accommodating portion of a housing, comprising:

a body configured to be inserted into the accommodating portion and a resilient portion projecting on the body, the resilient portion configured to contact an inner surface of the accommodating portion while being resiliently deformed, the resilient portion including projections at front and rear ends of an outer surface of the resilient portion while being spaced apart in an inserting direction of the terminal fitting, the projections being configured to contact the inner surface of the accommodating portion so that the terminal fitting is accommodated in the accommodating portion with a loose movement restricted.

3. The terminal fitting of claim 2, wherein the projections are embossed to bulge on the outer surface of the resilient portion.

4. A connector, comprising:

a housing including an accommodating portion having an inner surface, opposed first and second grooves formed in the inner surfaces of the accommodating portion and extending in an inserting direction; and a terminal having a body configured to be inserted into the accommodating portion of the housing along the inserting direction, the body having opposed first and second side walls and opposed top and bottom walls extending between the side walls, first and second resilient portions extending respectively from upper ends of the first and second side walls and folded out and down about fold lines extending along the inserting direction so that the first and second resilient portions are spaced outward from the respective first and second side walls, the first and second resilient portions being configured to contact opposed inner surfaces in respective first and second grooves of the accommodating portion while being resiliently deformed so that the terminal fitting is accommodated in the accommodating portion with a loose movement restricted.

5. The connector of claim 4, wherein each of the resilient portions has at least one projection projecting outward thereon and configured to contact an inner surface of the accommodating portion.

6. The connector of claim 5, wherein the at least one projection on each of the resilient portions comprises front and rear projections on each of the resilient portions and spaced apart along the insertion direction.

7. The connector of claim 6, wherein the projections on each of the resilient portions are at different respective distances from the upper end of the respective side wall.

* * * * *